US005784477A

United States Patent [19]

Konig

[11] Patent Number: 5,784,477

[45] Date of Patent: Jul. 21, 1998

[54] SYSTEM FOR THE FRONTAL LOCALIZATION OF AUDITORY EVENTS PRODUCED BY STEREO HEADPHONES

[76] Inventor: Florian Meinhard Konig, Schellenbergstrasse 7 D-82110, Germering, Germany

[21] Appl. No.: 541,368

[22] Filed: Oct. 10, 1995

Related U.S. Application Data

[63] Continuation-in-part of Ser. No. 820,698, Mar. 20, 1992, abandoned.

[30] Foreign Application Priority Data

Jul. 25, 1989 [DE] Germany ..... 39 42 127.9

[51] Int. Cl.[6] ..... H04R 5/00

[52] U.S. Cl. ..... 381/25; 381/183

[58] Field of Search ..... 381/182–184, 381/72, 74, 25

[56] References Cited

U.S. PATENT DOCUMENTS 3,751,608 8/1973 Weingartner ..... 381/159

4,027,113 5/1977 Matsumoto et al. ..... 381/192

4,875,233 10/1989 Derhaag et al. ..... 381/169

5,533,137 7/1996 Holmes ..... 381/187

*Primary Examiner*—Curtis Kuntz

*Assistant Examiner*—Ping W. Lee

*Attorney, Agent, or Firm*—Weingram & Associates, P.C.

[57] ABSTRACT

A static disposition geometry of the transducer systems of stereo headphones starting from the convention disposition of the headphones at the entrance to the ears, diagonally spaced downward in a forward direction (in in the direction of sight of the user). The conventional stereo headphones having essentially hemispherical housings with the transducer systems disposed in the center of the circular support structure closing the hempspherical housings from the users ears are modified by disposing these transducer systems at a position which is defined by a vector pointing forward in the direction of sight and predominately downward. The transducer systems are fixed in this later position. The amount of downward shift is greater than the amount of forward shift and may be greater than two to one.

11 Claims, 3 Drawing Sheets

SYSTEM FOR THE FRONTAL LOCALIZATION OF AUDITORY EVENTS PRODUCED BY STEREO HEADPHONES

CROSS-REFERENCE TO RELATED APPLICATIONS

This application is a continuation-in-part of U.S. application Ser. No. 07/820,698, filed on Mar. 20, 1992, now abandoned.

BACKGROUND OF THE INVENTION

This invention is directed to a stereo headphone for the in-front localization of auditory events produced by means of a stereo headphone having its acoustic transducer systems shifted from their usual disposition at a listener's outer ears by a given amount forward in the direction of the line of sight and downwards in the direction of the line of sight by an amount greater than the amount of forward shift to transform an audio event from appearing to be above, in the head of the listener, to an essentially horizontal frontal localized auditory event.

A static disposition geometry of the transducer systems of stereo headphones starting from the convention disposition of the headphones at the entrance to the ears, diagonally spaced downward in a forward direction (in the direction of sight of the user). The conventional stereo headphones having essentially hemispherical housings with the transducer systems disposed in the center of the circular support structure closing the hemp-spherical housings from the users ears are modified by disposing these transducer systems at a position which is defined by a vector pointing forward in the direction of sight and predominately downward. The transducer systems are fixed in this later position. The amount of downward shift is greater than the amount of forward shift and may be greater than two to one.

DESCRIPTION OF THE PRIOR ART

It is known that headphones are free-field or diffuse-field corrected, or corrected to be directionally neutral in favor of an outside the head localization of auditory events (K. Genuit: "Warum Freifeld" Report to the Berlin Radio Exhibition 1983, Rundfunktechnische Mitteilungen: Volume 1/1983, Pages 17 to 26; DE-A-3 131 347; Fortschritte der Akustik- DAGA 1987, Pages 477 to 480). The basis for this known method is an imitation of the human ear's capacity for directional localization. This has been adequately established statistically; that is, taking into consideration the upper part of the body, the trunk, the head, and the external ear relief, which are taken into account as a unit in the realization and correction of an artificial head, directional mixing console, and the headphone. In this area, there are today primarily two major kinds of developments for artificial heads, which can be classified into free-field corrected and diffuse-field corrected versions (Bruel & Kjaer Catalogue: "Head and Trunk Simulator 4128"; DE-A-3 146 706; Rundfunktechnische Mitteilungen: Volume 1/1981, pages 1 to 6). Moreover, until now only two directional mixing consoles have been developed which are preponderantly based on the free-field transmission of sound fields (HEAD-ACOUSTICS: Information Pamphlet and Report of the 13th Audio Operators' Convention, Munich, 1984. Pages 103 to 110; ARUSTISCHE U. KINO-GERATE GmbH: information pamphlet.). Concerning the particular importance of the individual adjustment of the "artificial head-headphone" system, reference is made to various aspects (J. Blauert: Spatial Audition, Postscript, New Developments and Trends since 1972, S. Hirzel Verlag, 1985; Acustica: Vol. 48, Pages 272 to 274). Here, special reference is made to the imitation, accurate to 1 dB, of the human ear's capacity for directional localization, as must be taken into account in processes for transmitting audio signals. With deviations in frequency response which are greater than 1 dB, an inside the head localization of auditory events is otherwise unavoidable, since in the case of reproduction via a headphone the procedure which assigns the auditory event to a sound source origin lacks the visual cues which are required for making the connection (G Plenge: The Problem of the Intracranial Localization of Sound Sources in Human Acoustic Perception, Habilitation, TU-Berlin 1973, pages 25 et seq.). It is therefore of considerable importance that the single stereo audio signal (which makes outside-the head localization possible) of an artificial head or of a directional mixing console be post-corrected individually and directionally upstream of the headphone which is compatible with the recording system) (F Konig,: DE-A-3 922 118).

Besides this, the measuring methods, the design of the measuring system and the results thus obtained, in conjunction with the determination of the transmission function of the external ear have been described in a survey (see above, Blauert: Spatial Audition, Postscript).

Derived as a more rapidly functioning and simplified procedure (for example, graphics are obtained after only a few seconds of measurement time which permit conclusions to be drawn concerning frequency-dependent distortions) this is demonstrated by F. Konig with respect to the sound-irradiation variant "headphone" (DE-A-3 903 246 and -3 912 582).

As for the recording and reproduction of directionally true sound irradiation, efforts have been made by, among others, Blauert\Boerger\Laws, Kurer/Plenge/Wilkens, Pleiderer, and so on, to reduce the annoying side effect of "localization inside-the -head" in the reproduction of audio recordings via sound irradiation using a headphone (DE-A-2 23 316, -2 628 053; -1 927 401, -2 244 162, -2 455 446, -2 557 519; Funk Technik, Vols. 6 and 7/1984, Special Printing, DE-A=-3 112 874).

The last process is particular (of P. M. Pfleiderer) may be stressed, since it offers, when used in close approximation to practice, not, as published, with the "Processor for out-of-Head Localization", a localization of auditory events which corresponds to the scientific term (see above, G Plenge, habilitation publication, 1973). This equipment is rather an effect processor, which constructs room acoustics subsequent to the stereo sound, but which does not realize one of the perceptions of the direction of sound possible in the natural three-dimensional localization of auditory events (diverging from the above-in-the-head localization). As has been shown, the directivity characteristics of the external ear contribute to this (see above, Blauert, Spatial Audition, Postscript).

As regards effect processors and their technical realization, a plurality of dissertations, publications and patent applications is forthcoming, which describe in particular the simulation of spatial reflection patterns. Accordingly, there is available today a wide range of such variably programmable reverberation and echo devices (including the factors spatial size, spatial structure and spatial design). In addition, a "New Kind of Presence Filter" (J. Blauert: Fernseh-und Kino-Technik, 1970, Vol. 3, Pages 75 to 78) has been known since as far back as 1970, as well as "A Model for Describing Characteristics of External Ear Transmission", where the correction of difference during the transition of the direction of sound incidence from "front" and horizontal in-front of the head to "laterally' at the ear is dealt with (K. Genuit: Dissertation, Technical University of Aschen 1984, pages 81 to 82).

Finally, it is know that auditory events can be localized in-front, more or less exactly horizontally when the headphone sound transducers are shifted forwards in the direction of sight, this been due to directionally specific linear corrections being produced while the auricle of the ear is subjected to close-range sound irradiation. Here, the sound transducers must be placed at least approximately ten centimeters forwards in the direction of sight for the effect described—the horizontal in-front localization of auditory events—to be achieved via sound irradiation using a stereo headphone. This is supported by expensively realized stereo headphones, which provide bass and middle/high tone sound transducers and signal feed in parallel, separately for the left and right auricles which are to be irradiated with sound, (DE-A-2 541 332); Funkschau (Radio Review): Vcl 10/1977, Pages 57 to 58 and 71 to 72).

A stereo headphone is known from U.S., Pat. No. 3,592,978. The sound transducers of this known stereo headphone are not conventionally disposed directly at the external ear relief, but rotated about a vertical axis and located at a distance to the external ear relief in such a way that they are shifted by a predetermined amount forwards in the direction of sight. This shifting amount in the direction of sight, however is so small as not to be sufficient to attain a horizontal in-front localization auditory events as is the case for the predescribed disposition of the sound transducers which are shifted for at least 10 ccm in the direction of sight to the front. Accordingly, U.S. Pat. No. 3,592,978 is silent on any hint concerning a horizontal in-front localization of auditory events to be derived via the stereo headphone described therein. Indeed the above mentioned inside-the-head localization of conventional headphones—which, in long term hearing sessions, is perceived as unnatural and annoying—is maintained.

A further stereo headphone is known in U.S., Pat. No. 3,751,608. This known headphone is provided with a disposition of the sound transducers similar to that one known for the headphone described in U.S. Pat. No. 3,592,978 having a lateral distance to the respective external ear relief and being frontally rotated so as to rest in the direction of sight in the horizontal plane. This headphone also has too small a shifting amount of the sound transducers-caused by the rotated position of the transducers—in the directions of sight for realizing a horizontal in-front localization of auditory events.

SUMMARY OF THE INVENTION

The object of the present invention is to design a stereo headphone so that an in-front localization of auditory events is reliably ensured based on a use of simple measures. Further, a method for optimizing the disposition of the sound transducers for the stereo headphones according to the invention is provided allowing a fast and reliable determination of the dispositions of the sound transducers, needed for said in-front localization.

Accordingly, the gist of the invention consists of a partial sound direction compensation "below", which is vectorial and counteracts the above-in-the-head localization, and also an additive emphasis of directionality "forwards", being applied in order to produce:

a) out of-the-head localization, or b) horizontal in-front localization of auditory events (independent of the audio recording process for producing, for example an audio preserve on a recording medium).

In other words, during the close-range sound irradiation of test subjects, a perception of directionality as being "horizontal in front", during the head-related stereophonic reproduction of, for example, artificial head audio recordings, is secured not solely by the (accurate to 1 dB) adherence to the individual directivity characteristic of human anatomical audition which is specific to the "in-front" direction of sound incidence, but also by a coalescence of the two components of sound incidence directionality, "below" and "in-front."

It should be pointed out in this connection if there is general neglect of the compensation shift according to the invention of "below" (of the headphone sound transducers), then this results in the same undesired perception of the direction of auditory events as presented when 1 dB threshold is exceeded with the individual's directivity characteristics: auditory events are perceived as being in-front in the direction of sight, but localized approximately 45° diagonally upwards (approximation of above-in the-head localization; this corresponds to the characteristic features of know head-related stereophonic recording and reproduction processes).

The method for optimizing the disposition of the sound transducers of the headphone in accordance with the invention ensures the minimization of the distance the headphone sound transducers have to be shifted permitting the in-front localization resulting therefrom. For this, with advantage, broadband diffuse-field corrected stereo headphones and/or their sound transducers are employed.

In connection with this method, it is advantageous that, with the use of solely the downwards compensation shift of the stereo headphone sound transducers to counteract the localization of auditory events above-in-the-head which normally occur, a "virtual auditory event" is realized (but, however, exclusive emphasis of the frontal direction), whose directionally cannot be determined unequivocally.

Furthermore, it is advantageous that, in order to realize an auditory event in the opposing horizontal direction of sight, in other words, behind the right and left channels be swapped of the dual channel sound event which has been corrected for the benefit of an in-front localization of auditory events.

It is also advantageous, when multichannel sounded transducers are being used to produce an improved spatiality or spatial acoustics for each auricle being subjected to sound, to select, besides the headphone sound transducers which have been placed frontal and below for the in-front localization of auditory events, a disposition of the headphone sound transducers in the opposite direction of sight, below and behind the external ear anatomy. All four sound transducers are separately signal fed.

Besides this, it is advantageous for the reproduction characteristics of stereo headphone sound transducers to be expanded to acoustic signals with the upper body and head reactions which have been described in detail by BLAUERT and GENUIT, for example, a superelevation of level, for instance a third wide of 3 dB at 300 Hz. This is particularly advantageous if the stereo headphone in accordance with the invention in it design, that is, in its transmission characteristics, has been corrected in accordance with a theoretical signal transmission basis (for example, in reflecting rooms). This is no longer exactly adhered to in the case of deviations from the conventional positioning of sound transducers, so that an adjustment of the sound pattern (for example, diffuse field post-correction) is undertaken. Here the narrow-band distortions produced by comb filter structures (bandwidth less than a third) are minimized acoustically over the whole range of hearing via broadband (band width more than a third) quasi-directionally neutral corrections (exploiting, among other things, the masking effect in the perception of acoustic stimuli in humans).

It is furthermore advantageous that the level setting of the headphone sound transducers by means of an amplifier with respect to the quality of electrical transmission characteristics should embody the following requirements:

useful signal-noise level headroom grater than 96 dB, audio volume range greater the 60 dB, linear distortions (max. deviation) less than 0.5 dB and non-linear distortions less than 0.1%

The following advantages may be attained with the aid of the invention vis-a-vis the state of the art:

a) independently of the procedure used for sound recording (whether mono or stereophonic, such as for example AB-XY-, support point, artificial head techniques), a horizontal in-front localization (stage effect) is realized, b) the reduction of the stereo base width which has occurred until now in the production of an in-front localization (the perceived stereo panorama, for example, being 180° with normal sound irradiation of the stereo headphone with localization above-in-the-head, is reduced to 120° (aperture angle) with headphone sound transducers permitting in-front localization by means of transducers shifted about ten centimeters forwards in the direction of sight, in accordance with the state of the art) has turned out to be considerably less (here greater that 160°, since there is a lesser shift distance);

c) the efficiency of the individual localization-shifting correction of the headphone type remains for the most part unaffected, whereby the frequency response and the sound transducers among other things need to be taken into account;

d) the kind and point in time of a desired shift in localization of head-related signals can be freely determined;

e) due to lack of knowledge or scientific statements concerning the existence of the compensation sound transducer (auditory event) shifting direction "downwards" counteracting the localization above-in-the-head (see literature above), in conjunction with a "forwards" emphasis in directionality, via headphone sound irradiation, the real-spatial acoustic characteristics of, for example, concert halls can be created, independent of the origin of the audio signals (cf. headphone quadrophony: predominantly above-in-the-head localization, a low proportion of the in-front sound-locating of "frontally intended" signals);

f) by means of considerably preponderant downwards shift of the headphone sound transducers in comparison to the forwards shift with respect to shift distance, well over half of the shift distance which has been required, to date for adequate auditory events is saved;

g) thus what would otherwise be the normal bass losses with sound transducers arrangements in front of the auricle which permit in-front sound-localization are reduced to a low value, and do into demand additional bass sound transducers directly at the auricle (besides the middle/high frequency sound transducers);

h) a recording method using artificial head and/or directional mixing console and based on the ear's average directivity characteristics results rather in the directionally accurate representation of sound, since the above-in-the-head localization is reduced individually, but noticeably too with average correction, by means of "downwards" reproduction compensation correction;

i) thus the direct-locating information built up by the artificial head recordings for differentiating between "front" and "behind", among other things, is strengthened;

j) for this reason, even the introduction of an "average" filter to provide the influence desired on the headphone sound locating position promises success (the "average" compensation correction in comparison provides an in-front localization which is better than a sound source which is received "frontally" solely from the artificial head as well as reproduced uncorrected via a headphone);

k) a measured, geometrical, "average" disposition of the sound transducers of a stereo headphone favoring the horizontal in front positioning of the auditory event will produce the perception of sound stimuli in the horizontal in-front direction of sight, due to the individual effects of the shape of the external ear (precondition: parsons in good health with respect to audition anatomy);

l) the outlay on measurement technology which has been required to date for an electrical, filter-bound, head-related, individual frontal correction (including the necessity of an expensive acoustically inert or low-reflective measurement room) now turns out to be more favorable with regard to costs; and m) a possible exploitation, outside the usual hi-fi application, of a stereo headphone which permits in-front localization is offered, for example in conjunction with telecommunications (agreement of the auditory (speaker) event and the visual event on a monitor image located in front of oneself).

BRIEF DESCRIPTION OF THE DRAWINGS

The invention will be explained in more detail in the drawings in which.

DESCRIPTION OF THE PREFERRED EMBODIMENTS

First, the essential effects of a test for the locating of auditory events which is typical for the invention were explained to the subject, who was irradiated with sound from at set of headphones. A special part of this was the precise discrimination and classification of in general:

a) above-in-the-head localized (ie. located 90° vertical "on the top of the head") as well as, b) in-front-outside-the-head localized (ie. located 0° horizontally forwards in the direction of sight) auditory events, this being demonstrated by the persons conducting the tests.

Once a fluent transition between a) and b) exists, especially in the impending test for determining the place where the new headphone sound transducers which permit in-front localization should be located, for example, a sound event perceived as being at an angle of elevation of 45° in the direction of sight (in the median plane) in front of the forehead— this sound-locating capability gained a particular importance. The aim was that the test subject independently would be able to realize a horizontal in-front localization (in accordance with b) at any time by means of the headphone sound transducers being shifted, normally while listening to music which was perceived as pleasant. This is termed the "stage effect", since the localization of the auditory event which is perceived subjectively is simulated as "in-front" when, in reality, no orchestra, for example, exists at that position.

In this connection any kind of audio or sound recordings are recommended which were recorded using intensity stereophonic techniques. Artificial head music productions are unsuitable because under certain circumstances no clearcut above-in-the-head localization is found via stereo headphone.

Figure 1:
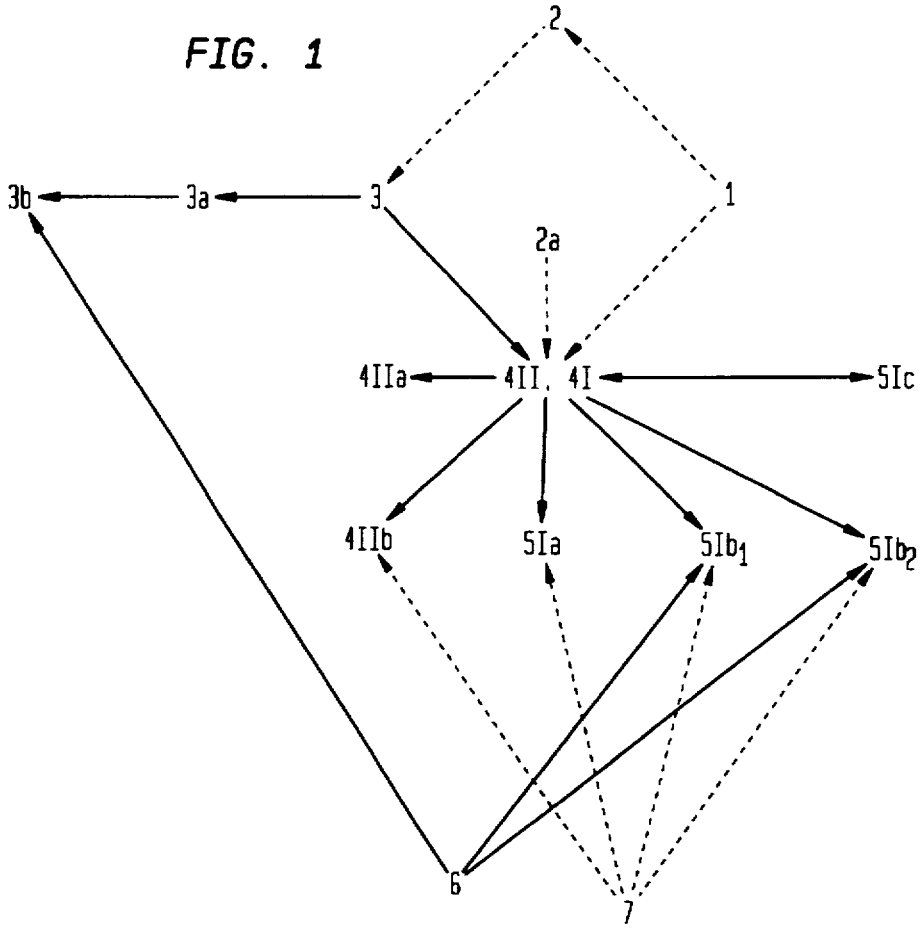
FIG. 1 shows the vectors of sound-locating components which are located on a vertical plane, and which occur during the shifting process of the sound transducer of a conventional headphone to a position ensuring the in-front localization of auditory events in accordance with the invention.
Figure 2:
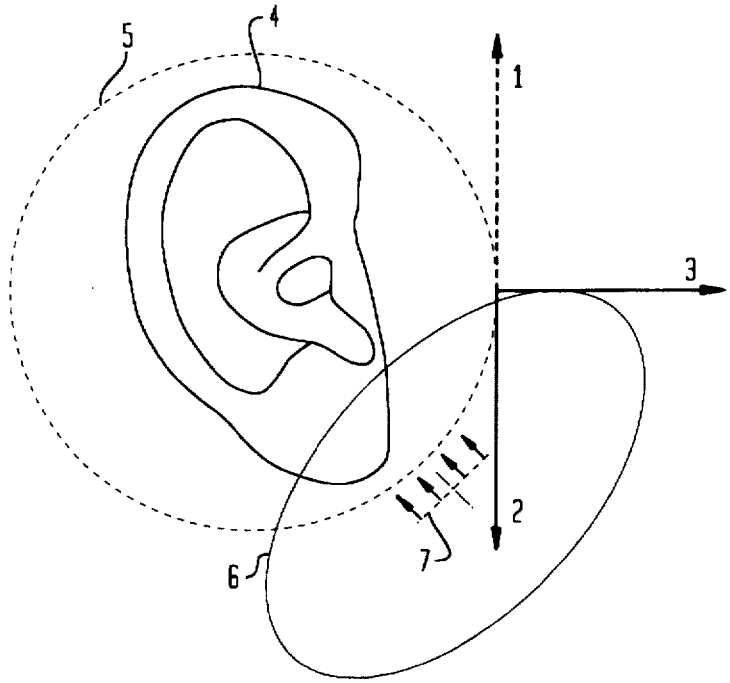
FIG. 2 shows the vectors of sound-locating components which are located on a vertical plane, and which occur during the shifting process, according to the invention, of the headphones sound converters.

Before the test subject constructs the "stage effect", ie. horizontal in-front localization, a schematic overview of the mode of procedure should be laid down beforehand. Referring to FIGS. 1 and 2, there is shown with an aid of a vectorial representation on the median plane the components 1 of locating sound sources with unmodified, ie, worn according to the manufacturer's instructions, stereo headphone sound transducers (reference numeral 5 indicates the outlines of one headphone box). This localization corresponds to the above-in-the-head localization 1 of auditory events with sound irradiations via a stereo headphone. A second vector 2 forms the above compensation direction "below" when the disposition of the stereo headphone sound transducers is shifted. With this, the part of sound sources location for the above-in-the-head portion 1 is eliminated. Vector 3 represents the emphasis of the perception of the direction of the auditory event as being "in-front", that is "the stage effect." Here the stereo headphone, which is worn on the external ear in accordance with the manufacturer's instructions (represented in the outline of the headphone box 5), are moved following the movement vectors 2 and 3 into a position which permits in-front localization of the auditory event (see element 6 in FIG. 2). In addition, the headphone sound transducers 6 are moved to the external ear 4 at an angle of, for example, 30° for an evaluation of acoustic efficiency (in accordance with the perspective-isometric representation of the outlines on headphone sound transducers 6). The direction of the spreading of sound is represented here by means of vectors 7.

These procedures, which are treated schematically in theory, in accordance with FIG. 1, are to be put into practice. In this connection it is important that the test subject once more is subjected to sound irradiation, music for example, in "stereo" via a headphone. All commercially available products are suitable as test headphones, which a) work on the "open" principal and also, b) enclose the ear, c) have an adjustable headband and also, d) possess sound transducers which can be adjusted on multiple axes, and e) whose sound transducers (for each channel) correspond rather to a point source of sound. Wide surface radiators with for example dimensions of 100×100 millimeters are unsuitable within the context of the direction-finding test.

For the set bound of "horizontal in-front localization" of auditory events the following interactive working method is adopted.

First of all, the stereo headphone is put on as the manufacturer's instructions state, and then the signal level for the acoustic transducer is set. Then both headphone sound transducers are lifted off with both hands approximately far enough from the surface of the head/side of the temples (about 5 to 10 millimeters) that the headphone paddings just barely contact above the auricles. Then the headphone sound transducers are moved, paying attention to the spatial position of the auditory event, in small steps less than 5 millimeters, forwards (in the direction of sight) and downwards (vertically in the direction of sight) in each case. After, in general, 15 millimeters of two-dimensional shift distance, a striking shift in the localization of auditory events is produced (angle of elevation in the median plane of for example 30° forwards), which causes a shifting process of the stereo headphone to be realized, which now no longer varies but which is made dependent on the individual case of shifting in locating the auditory event. In the example which has been just given, with a 30° angle of elevation, an adequate forward emphasis of the auditory event can already be assumed, and for this reason an additional compensation shift amounting to a few millimeters downwards is recommended (directed in the opposite direction to the above-in-the-head localization). If this shift produces a position for the auditory event which still does not correspond to the horizontal in-front localization, then the shift downwards which was just made is halved with respect to the millimeter distance selected, that is reduced to half. Then the "stage effect"being sought is optimized by means of further reduced shifting steps, also in an empirical manner, either added or subtracted. In this example, at first a shift of one to two millimeters forwards was selected, and only after this the further, empirical, balancing process of shifting. When the new disposition of the stereo headphone has been found which permits in-front localization, then, finally, a) a tiny safeguard shift of about one millimeter downwards in added, and b) in order to improve the efficiency of the sound irradiation of the auditory canal or meatus, both headphone sound transducers are arranged at an angle towards the auricle/auditory canal (about 20° to 40° azimuth and elevation angle in the horizontal and in the median plane). If the perceived position of auditory events alters unfavorably here, then once more a minor corrective movement, see above, from "empirical, balancing process of shifting" of the headphone sound transducers is made, with the headphone being held at an angle.

To provide an example, with a headphone model which is widely available commercially (open, enclosing the ear) and which possesses a circular sound transducer (diameter approximately 30 millimeters), a final shift distance vertically downwards of 45 millimeters and forwards in the direction of sight of 15 millimeters (with an azimuth/elevation of 35°) is obtained. On the other hand, these numerical values from the final shift distance reduce by approximately 50% when a walkman headphone model is used, which sits on the ear. Here the auditory canal serves as a reference point, in front of which a headphone box is located which is worn in accordance with the manufacturer's instructions and is usually arranged centrally. With test subjects this corresponds to a current ratio of 3:1 (comparison of the downwards and the frontwards shift distances).

With reference to an alternate multichannel sound irradiation of the external ear, besides a sound transducer system which permits in-front localization and which has been placed frontal-below (for each auricle) (level setting with direct or unprocessed audio signal), a secondary sound transducer system to be placed (level setting using a spatial reflectivity pattern), which in the normal case is located vis-a-vis the auricle in accordance with the manufacturer's instructions, and which is to be shifted backwards and downwards, on the basis of the auditory canal reference point, and finally placed in position. With regard to finding the rest disposition for the sound transducer which is suitable for this the steps mentioned above are carried out. In this connection a minimal shift distance with maximum effect is sought, which produces "virtual" (term: see page 1 et seq.) auditory events with a light at-back or at-rear localization of sound when such sound transducers which have been placed downwards and backwards are modulated with stereophonic sound signal.

Note: A general backwards and downwards positioning of sound transducers for the at-rear localizing of auditory events with sound irradiation using a stereo headphone is too costly and thus less practical due to the shape of the external ear ("anatomical" directionally-dependent filter) which produces larger shift distances.

Finally when the sound transducers which have been placed frontal and downwards (I)and backwards and downwards (II) are fed with audio signals (directed sound signal for (I) and spatial reflection patterns for (II) which were originally assigned, then an auditory event is presented, which has been re-evaluated three-dimensionally with respect to space, and once more broadened.

This position for the stereo headphone sound transducers, which also permits in-front localization is kept constant until the collection of data within the shape of the disposition geometry or of the external ear attenuation factor has been completed.

Measurement of Linear Distortions when the Headphone is shifted

In order to simulate an in-front localization which is independent of the shift in direction, a frequency-dependent difference level formation is applied, from which, according to invention, the necessary, frontal direction specific, additive subsequent precorrection of the stereo headphone sound transducers is obtained as follows:

Firstly, suitable probes are implanted about 4 millimeters within the auditory canal. Suitable means that the probes, which have been post-corrected, do not falsify the measurements as a whole (sound volume range greater than 58 dB, harmonic distortion coefficient less than 0.1%, frequency response from 20 Hz to 20 kHz), or do not injure the test subjects. The probes are miniature microphone capsules which take acoustic signal samples from the auditory canal or meatus via a sound feeder similar to a hose.

For a digital processing of the signal at a later date it would make more sense to use so-called "digital microphones" (known in the sound recording studios). Suitable types are at present not available on the market.

The analog electrical alternating signal (about 10 millivolts) produced by the miniature microphone is usually amplified to a voltage level higher than 0.5 volts (technical data for amplifier quality for a microphone), in order that analog-to-digital converters used later to process this signal further, before the actual EDP systems, do not operate within a quantization area and thus would present an insufficient release or sound signal sampling quality.

From a multiplicity of measuring methods (see pages 1 et seq.) the sinus sweep from 20 Hz to 20 kHz was selected, since an immediate disclosure of the external ear-headphone sound transducers reaction, in the form of frequency-dependant level fluctuations, underlies the process. A sound level is normally selected of less than 75 dBSPL.

Subsequent formation of a difference signal level, which is composed from the (representative) frequency response diagrams "headphone normal" (placed at the auricle in accordance with manufacturer's instructions) and "varied positions", i.e. level values of the first-named diagram minus those of the second-named diagram, corresponds to, for example, the curve shown in FIG. 2, which was recorded using the external ear of an individual person (with a tendency towards "average" sound-locating characteristics):

Primarily, two broadband 4dB increases attract attention, around 1.8 and 3.6 Hz, as well as a broadband 18 dB-deep depression between 5 kHz and 8kHz (max. level 5.5 dB), around 8.5 kHz (max. level 3 dB) and an intrusion at 11 kHz (min. level minus 7dB). From about 12 kHz resonances and depressions alternate with rhythm of approximately 2 kHz, in a manner similar to comb filters.

The difference level-frequency response graph shown, which was measured with one person (no. 1) no longer contains any level inequalities below the 1 kHz frequency which are relevant for in-front localization produced by headphones. This is correct and has general validity, since a) the shape of the external ear relief can function as an acoustic damper and resonator only above a frequency of about 1 kHz on account of its dimensions, and b) the continuous decrease in frequency response down to bass portions show that reduced efficiency of "open" sound transducers with a stereo headphone not being placed (worn) at the external ear in accordance with manufacturer's instructions.

For this reason this lower frequency response area was again intensively investigated by means of audition tests in order to improve a sound signal-broadband horizontal in-front localization of auditory events, to see whether this area should be effectively expanded by means of additive level increased (eg. one third wide +3 dB at 300 Hz) and/or decreases.

In contrast to the other difference level diagrams, the relative drop in frequency response below 1.8 kHz, the depression in the 5 to 8 kHz region, the accentuation between 1.5 and 5 kHz, and at 8 kHz and also those averaged above 12 kHz crystallize out here particularly. The salient points in the frequency response can be distributed over some hundreds of Hertz with respect to frequency. Furthermore, a relative accentuation of about one third in width (1 to 3 dB) can be seen sporadically below 500 Hz.

Figure 3:
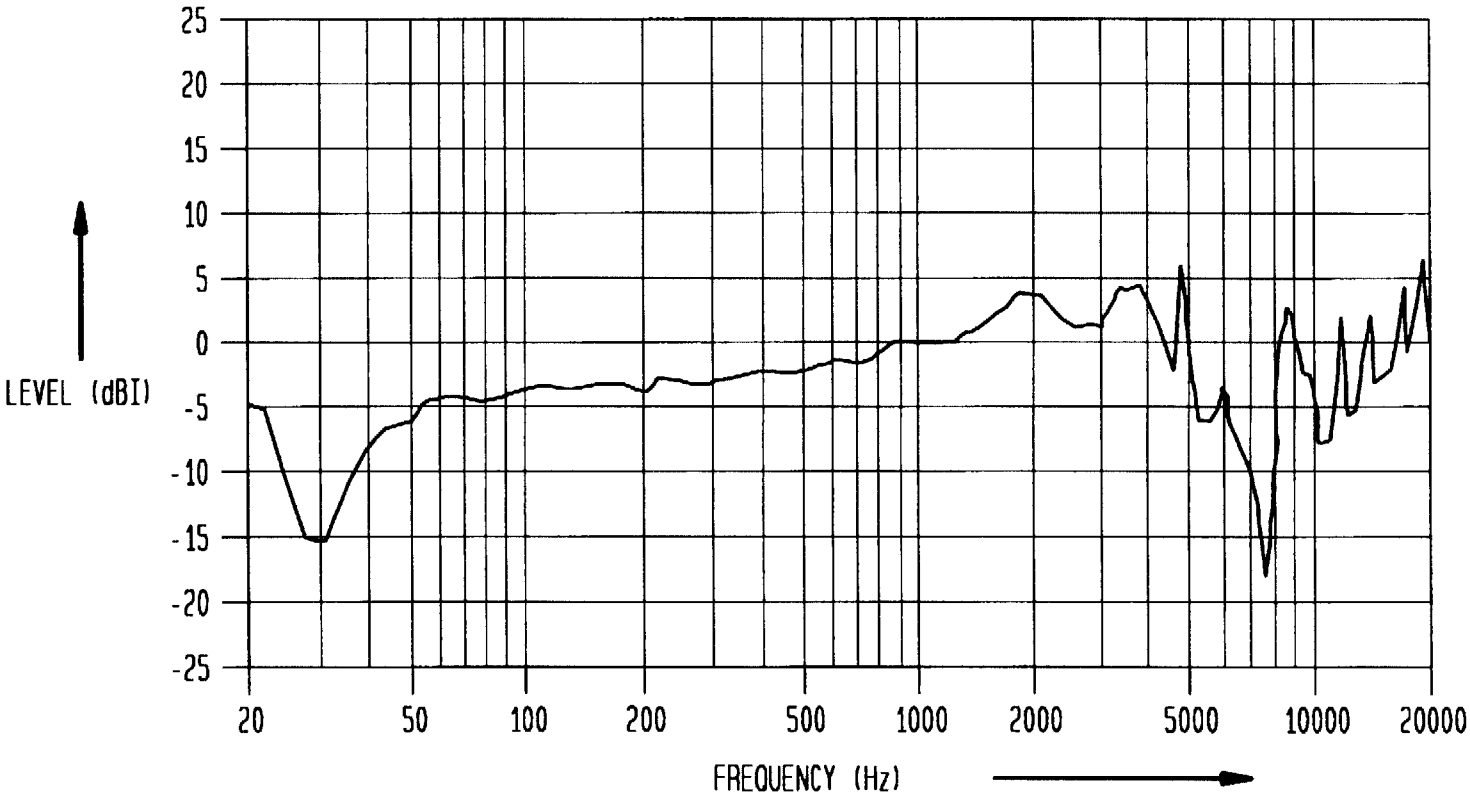
FIG. 3 shows a frequency-dependent difference level record similar to FIG. 2, but for test subject no. 2.

The salient bass intrusion of minus lOdB with respect to the continuous decrease in frequency response towards the low frequencies (about 5 dB in comparison to the 1 kHz level value) was produced by an error while carrying out measurements. This is supported by FIG. 3, which presents further recording of linear distortions with the present disposition in the stereo headphone of the sound transducers which permits in-front localization. A further volunteer (second) test subject was available for the measurements shown in FIG. 3. Despite the different anatomical characteristics of the external ears of test subjects I and II, there was a high correlation in the important frequency range between both difference level graphs (compare FIG. 2 with FIG. 3), which is supported by the level excess values at frequencies below 2 kHz, 4 kHz, and 8 kHz, as well as the damping intrusions around the frequencies of 6 kHz and 11 kHz. Similarly, in FIG. 3 a continuous decrease in frequency response as far as the low frequencies can be determined, which is seen and is similar to that in FIG. 2.

Figure 4:
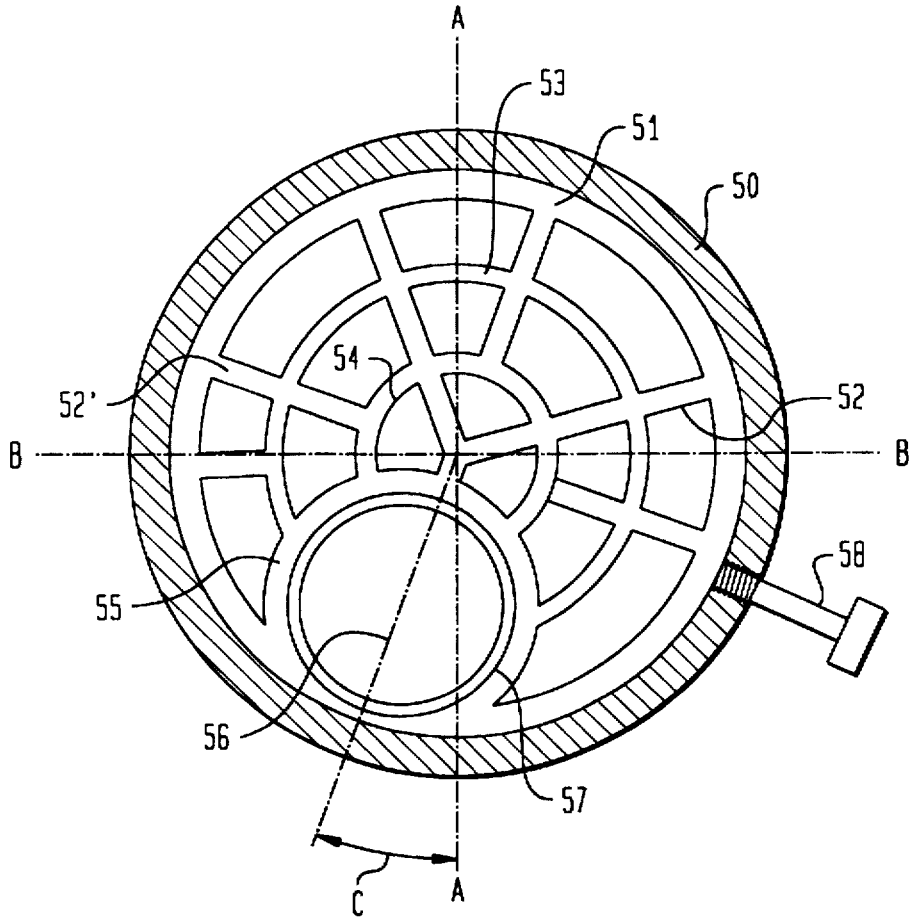
FIG. 4 is a diagrammatic view of one of two hemispherical retainers of the stereo headphones for supporting acoustic transducer systems.

FIG. 4 shows one of the two hemispherical retainers of stereo headphones which are adapted to support acoustic transducer systems. More specifically, FIG. 4 is a side view of a transducer system retainer 50, namely the side thereof which is oriented towards the ear of a stereo headphones user to the head of which the retainer 50 is coupled via a soft cushion or pad which is not shown in the Figure. In the view of FIG. 4, the retainer or housing 50 is cut in a plane in which the retainer 50 retains a support member 51. The support member 51 has a circular outline, and the outer diameter of the support 51 is somewhat smaller than the inner diameter of the retainer 50 which is recessed in order to be able to properly retain the support 51 in a rotatable manner. The support 51 comprises a plurality of radially extending straps of stays 52, 52' etc., so that the support 51 has the form of a spoke wheel, the spokes of which join in the center and additionally are joined via concentric angular portions 53 and 54 to structionally stabilize the support member 51.

Adjacent to the center of the support member 51 as well as to the outer rim thereof is provided a circular support member 55 which is joined to the spokes 52, 52' as well as to the outer rim of the support member 51 and members 53 and 54. Circular support member 55 is intersected by a radius of support member 53 as indicated at 56. Circular support member 55 has a recessed inner rim 57. The inner rim 57 is adapted to directly support thereon a transducer system having a circular outline and being adapted to fit directly onto the recessed rim 57.

As already mentioned, support member 51 may be rotated within the retainer 50 so that the circular support 55 for supporting an acoustic transducer system also is rotated with respect to the retainer 50 in the direction of arrow C.

FIG. 4 shows a preferred disposition of support member 51 so that circular support 55 and hence an acoustic transducer system supported thereby is positioned in accordance with the present invention. This disposition of the acoustic transducer system shall be explained relative to a vertical direction (straight line A—A in FIG. 4) and a horizontal direction (straight line B—B in FIG. 4), wherein the horizontal direction B—B corresponds to the direction of sight of the user of the stereo headphones, whereas the vertical direction A—A corresponds a downward direction vis-avis the direction of sights. Support member 51 has been rotated in FIG. 4 so that circular support 55 and the acoustic transducer system supported therein is shifted by a given amount forwards in the direction of sight and downwards in the direction of sight by an amount greater than said given amount for transforming the auditory event obtained by such stereo headphones into an essentially horizontally frontally localized auditory event, said shift starting from a central position (intersection of directions A—A and B—B) of retainer 50 which the conventional position of an acoustic transducer system in stereo headphones. Therefore, support member 51 together with circular support 55 define a mechanical structure for shifting downward and forward of the transducer system.

There is provided a screw 58 rotatably inserted into the outer wall of the retainer 50 and adapted to releasably engage the outer rim of support member 51 to fix the rotation position thereof vis-a-vis the retainer 50.

While the invention has been described in its preferred embodiments, it is to be understood that the words which have been used are words of description rather than limitation, and that changes may be made within the purview of the appended claims without departing from the true scope and spirit of the invention it its broader aspects.

I claim:

1. Stereo headphones having a pair of retainers adapted to hold acoustic transducer systems, each one of the retainers comprising:

a hemispherical shaped housing;

a first circular shaped support member having an outer diameter less than an inner diameter of the hemispherical shaped housing to be seated in the housing for independent rotation therein; the first circular shaped support member having;

a plurality of spokes radiating outward from a common central point of the first circular shaped support member to be connected to the support member at separate and discrete locations thereon, a plurality of concentrically arranged angular portions interconnecting the plurality of spokes;

a second circular support member connected to the first circular support member and extending toward the common central point, the second circular support member connected to at least one of the plurality of spokes and to at least one of the plurality of concentric angular portions and having:

a recessed inner rim adapted to support thereon an acoustic transducer system having a corresponding circular shape adapted to be disposed in the recessed rim;

a screw extending from an exterior surface of the hemispherical shaped housing through to the first circular shaped support member for contact therewith, the screw adapted for rotation to releasably engage the first circular support member to position the first circular support member with respect to the hemispherical housing;

wherein the first circular support member is independently rotatable within the hemispherical housing to move the second circular support member with the acoustic transducer system in a direction relative to a line of sight of a user and simultaneously at an angle with respect to external ear relief of the user such that the acoustic transducer system is disposed for transforming an auditory event generated by the headphones into a substantially horizontally frontally localized auditory event.

2. Stereo headphones having acoustic transducer systems, comprising:

means for retaining an acoustic transducer system;

means for positioning the acoustic transducer system at a select position with respect to external ear relief of a user, the positioning means mounted for independent movement within the retaining means for positioning an acoustic transducer with respect to a line of sight of the user and simultaneously at an angle with respect to the external ear relief to arrive at the select position; and means for supporting and partly enclosing the acoustic transducer, the supporting means joined within the positioning means for simultaneous movement therewith to support the acoustic transducer during movement of the positioning means and at the select position;

wherein movement of the positioning means with respect to the retaining means simultaneously moves the support means to the select position to provide a substantially horizontally frontally localized auditory event.

3. The stereo headphones according to claim 2, wherein the retaining means comprises:

a hemispherical housing having:

an interior wall sized and shaped to receive the positioning means for independent rotational movement therein.

4. The stereo headphones according to claim 3, wherein the positioning means, comprises:

a circular member having:

a rim portion sized and shaped to be retained for rotational movement against the interior wall of the hemispherical housing.

5. The stereo headphones according to claim 4, wherein the circular member comprises:

a plurality of spokes radiating outward from a common central point of the circular member, each one of the plurality of spokes extending to be connected to the circular member at separate and discrete locations thereon.

6. The stereo headphones according to claim 5, wherein the circular member further comprises:

a plurality of concentrically arranged angular portions interconnecting the plurality of spokes.

7. The stereo headphones according to claim 2, wherein the support means, comprises:

a circular portion joined to the positioning means and intersecting some of the concentrically arranged angular portions, the circular portion having a rim along which a recess is formed in which the acoustic transducer is disposed.

8. The stereo headphones according to claim 2, further comprising:

means for securing the positioning means with respect to the retaining means, the securing means adapted to releasably engage the retaining means with the positioning means such that the acoustic transducer system remains at a predetermined position with respect to the external ear relief to provide a substantially horizontally frontally localized auditory event.

9. The stereo headphones according to claim 8, wherein the securing means comprises:

a screw threadably inserted through the retaining means for releasable engagement with the positioning means.

10. The stereo headphones according to claim 2, wherein;

the acoustic transducer system is adapted to be shifted by a given amount forward in the direction of sight and downwards in the direction of sight by an amount greater than said given amount, for transforming the auditory event obtained by the stereo headphones into a substantially horizontally frontally localized auditory event.

11. A method of frontally localizing auditory events produced by stereo headphones, the method comprising the steps of:

providing a pair of stereo headphones having a housing partly enclosing a sound conveying transducer;

positioning the housing over external ear relief of a user;

retaining the housing at a selected position over the external ear relief;

shifting said sound conveying transducer by a predetermined amount independent of the housing along a line of sight from a position at the external ear relief without affecting the position selected for the housing;

simultaneously shifting the sound conveying transducer by a second predetermined amount downwards from the line of sight by an amount greater than the distance shifted forward for transforming an above-in-the-head localization of the auditory event into a substantially horizontal frontally located auditory event.

* * * * *